US005374071A

United States Patent [19]

Johnson

[11] Patent Number: 5,374,071

[45] Date of Patent: Dec. 20, 1994

[54] FOOT SUPPORTING ROLLING DEVICE WITH SPEED REDUCER AND BRAKE

[76] Inventor: Lennart B. Johnson, Federal Hill Rd., Milford, N.H. 03055

[21] Appl. No.: 57,691

[22] Filed: May 4, 1993

[51] Int. Cl.[5] ..... A63C 17/14

[52] U.S. Cl. ..... 280/11.2; 188/25

[58] Field of Search ..... 188/2 F, 25, 27; 280/11.2, 11.19

[56] References Cited

U.S. PATENT DOCUMENTS

| | | | |
|---|---|---|---|
| 606,496 | 6/1898 | Allen | 188/25 |
| 650,228 | 5/1900 | Cattaneo | 188/25 |
| 926,646 | 6/1909 | Eubank, Jr. | 280/11.2 |
| 1,501,589 | 7/1924 | Ferris | 188/25 X |
| 3,156,324 | 11/1964 | Colbert | 188/25 X |
| 4,312,514 | 1/1982 | Horowitz et al. | 188/25 X |
| 4,805,936 | 2/1989 | Krantz | 280/842 |
| 4,987,978 | 1/1991 | Jungersen | 188/2 F |
| 4,989,403 | 2/1990 | Johnson | 280/842 |
| 5,183,275 | 2/1993 | Hoskin | 188/25 X |

FOREIGN PATENT DOCUMENTS

| | | | |
|---|---|---|---|
| 22575 | of 1897 | United Kingdom | 188/25 |

*Primary Examiner*—Mitchell J. Hill
*Assistant Examiner*—Michael Mar
*Attorney, Agent, or Firm*—Fish & Richardson

[57] ABSTRACT

A rolling device such as a roller ski or in-line skate that uses a roller of a hard material with the roller mounted to the frame of the roller ski or in-line skate in such a manner that it can be forcibly moved to contact the elastomeric wheel of the roller ski or in-line skate, causing the softer elastomeric material of the wheel to displace about the harder roller, resulting in a significant increase in rolling resistance with minimum frictional wear. A roller ski or in-line skate that uses, in conjunction with the aforementioned roller, a lever actuated brake permitting the roller ski or in-line skate to be stopped on down hill slopes.

19 Claims, 2 Drawing Sheets

FOOT SUPPORTING ROLLING DEVICE WITH SPEED REDUCER AND BRAKE

BACKGROUND OF THE INVENTION

The invention relates to rolling devices such as roller skis and in-line skates.

Roller skis are very short skis that have front and rear wheels and are used for training devices by skiers when snow is not available. They are also used by many athletes in other sports. Studies by exercise physiologists have shown that roller skis are one of the most effective methods of training for all endurance sports including running and cycling. In-line skates have small narrow wheels positioned one after the other, i.e., in line. In-line skates are used for recreation, for training ice skating in off season or for general aerobic conditioning. In the U.S. roller skis and in-line skates are typically used on roads or park paths. In Scandinavia and Central Europe, as well as in several places in North America, there are now specific roller ski and in-line skate tracks. Each year these forms of training and recreation are becoming more popular, resulting in the building of more tracks specifically designated for these activities.

A major problem with roller skis and in-line skates has been the inability to slow down or stop when going down hills. A few prior art roller skis have used frictional brakes rubbing against the tire or hub of the wheel. U.S. Pat. No. 4,898,403 describes the use of kinematic damping to provide the necessary resistance for optimal training and slowing roller skis on less steep hills, but did not provide variable (adjustable) resistance or quick stopping.

SUMMARY OF THE INVENTION

In one aspect, the invention features, in general, a foot-supporting rolling device such as a roller ski or an in-line skate that employs a speed reducer. The rolling device includes a foot supporting structure for supporting a user's foot, wheels that are rotatably mounted on the foot supporting structure, and a roller that is mounted on the foot supporting structure in such a fashion that it can be forced against one of the wheels so as to provide a substantive resistance to the rotation of the wheel.

In preferred embodiments the roller is mounted on a first pivotable member, the first pivotable member is moved by a second pivotable member forcing the roller against the elastomeric tire causing rotational resistance by forcing the softer elastomeric compound to displace about the hard roller. The first pivotable member, containing the roller, has a lobe contact member that engages corresponding indentations of the second pivotable member. The first pivotable member is also spring loaded so that it will return to a neutral position where the roller does not contact the wheel. The second pivotable member has an extended portion which can be gripped by a hand for moving the member about the pivot. The forward portion of the second pivotable member is shaped with multiple indentations matching the lobe of the first pivotable member thus causing the two members to engage, with sufficient resistance at each indentation, so that the two members stay locked until the operator grips the extended portion of the second member and forcibly moves it. Each progressive indentation of the second pivotable member is located farther from the pivot center, thus causing the roller mounted on the first pivotable member, to penetrate the tire more deeply as the second pivotable member is moved by the operator to indentations farther from the pivot center. In preferred embodiments, the geometry is such that a force applied at the extended portion of the second pivotable member produces a force at least ten times as great at the roller of the first pivotable member. Thus a relatively small force at the end of the second pivotable member produces a relatively large force at the roller of the first pivotable member, making it easy to force the roller into the elastomeric wheel.

Preferably the roller is a ball bearing with an outside diameter of 16 mm to 40 mm, the preferred diameter being 22 mm. The outer case of the bearing is very hard. The bearing can also be pressed into a secondary cylindrical member. In preferred embodiments, both pivotable members are housed in a frame structure which surrounds the members and is so configured that it matches the outer profile of the roller ski and is fastened to the roller ski with the regular wheel bolt. A similar structural housing is suitable for in-line skates.

The invention also features a lever actuated brake with a brake pad of a very hard material which contacts the outer diameter of the tire. The brake is actuated by pulling a coiled cable attached at one point to the lever and at the other end held in place by a leg strap which, in preferred embodiments, is mounted above or below the knee of the user. In preferred embodiments of the brake, which preferably is used in conjunction with the speed reducer, the lever contains a replaceable cylindrical brake pad of a very hard material. Preferably the brake pad should be harder than Rockwell 55C. The lever has a leverage ratio of between 1:1 and 15:1 with a preferred ratio of 4:1. In preferred embodiments, the lever, brake pad and a return compression spring are housed in a frame structure which surrounds the members and is so configured that it matches the outer profile of the roller ski and is fastened to the roller ski with the regular wheel bolt. A similar structural housing is suitable for in-line skates. In preferred embodiments the plastic coated self coiling steel cable is 1/16" diameter and is fastened to the lever by a clip so it can be removed. The cable is attached to the user with a leg strap wrapped about the leg, either above or below the knee. The cable has a loop of sufficient size to permit two or three fingers to readily penetrate and grab the loop so it can be pulled, forcing the brake pad, mounted on the lever, against the outer diameter of the wheel.

Roller skis and in-line skates made according to the invention have variable rolling resistance and a secure method for stopping. With the increased rolling resistance provided by the speed reducer, it is now feasible to employ a practical frictional brake that does not overheat or have excessive wear. (An analogy of the system would be a shift car going down a steep mountain road in neutral. Unless the brakes were extremely efficient they would get hot and fade.) Since roller skis have very small wheels and must be very light in order to simulate cross-country skiing, it is impractical to provide sophisticated heat dissipating brakes. The speed reducing roller device acts as a gear box, and with the speed reducer engaged there is sufficient rolling resistance to enable a less complex friction brake to work effectively. The invention permits slower and safer downhill runs on steeper pathways and roads, as well as variable resistance on flat surfaces. The invention enables roller skis to be stopped, even on steeper hills. The invention, unlike prior art devices, has a long life and has been proven very effective.

Other advantages and features of the invention will be apparent from the following description of a preferred embodiment thereof and from the claims.

DESCRIPTION OF THE PREFERRED EMBODIMENT

The preferred embodiments will now be described.

DRAWINGS

Structure

Figure 1:
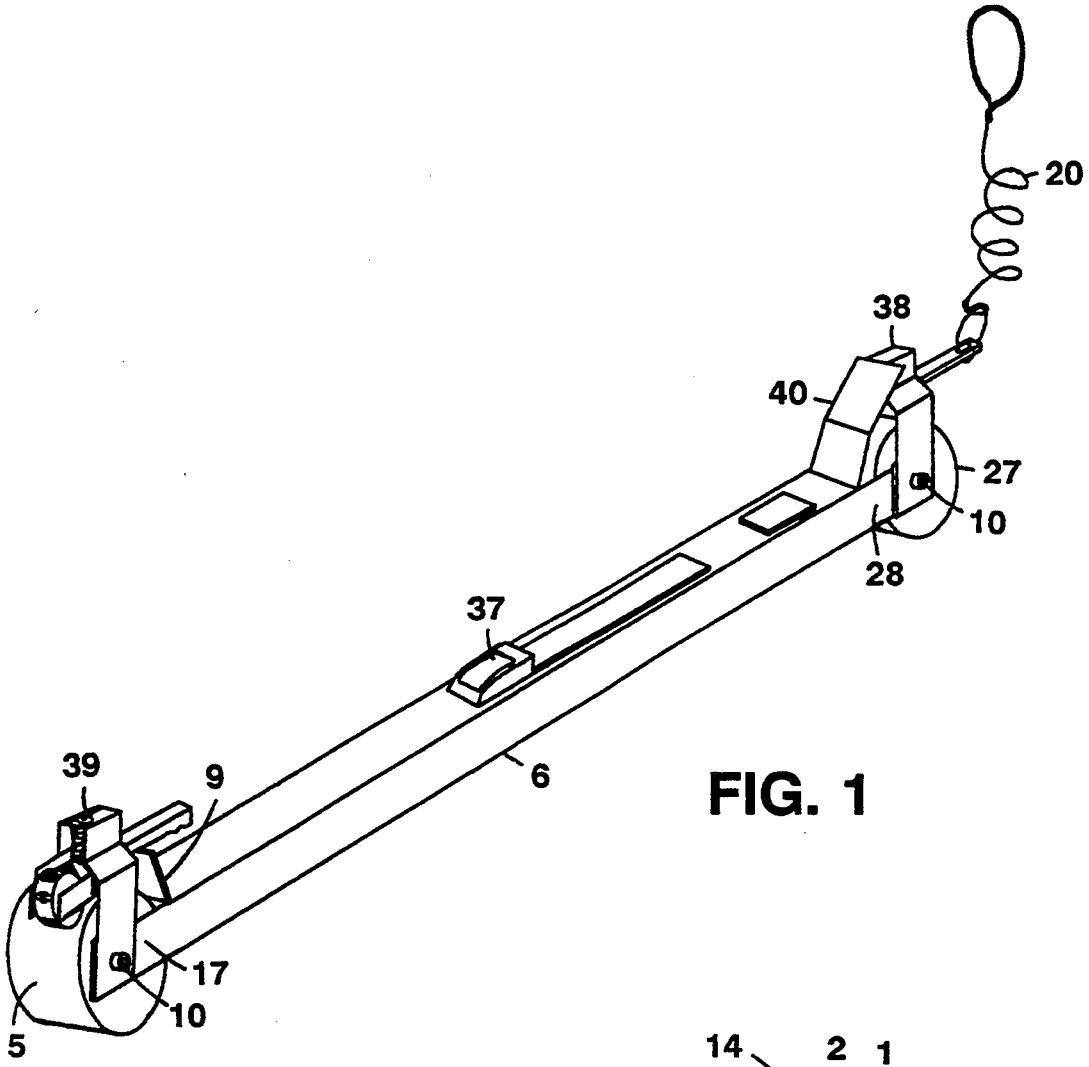
FIG. 1 is a diagrammatic perspective of a roller ski according to the invention.

Referring to FIG. 1 there is shown the aluminum base member of the ski 6, the machined forks (cutouts to accept the wheel) 17 and 28, the binding 37, the brake 38 mounted to rear wheel fork 28, the speed reducer 39 mounted to front fork 17, the front wheel 5, the rear wheel 27, the retaining bolt 10, the front fender stop 9, the rear fender 40, and the cable 20.

Figure 2:
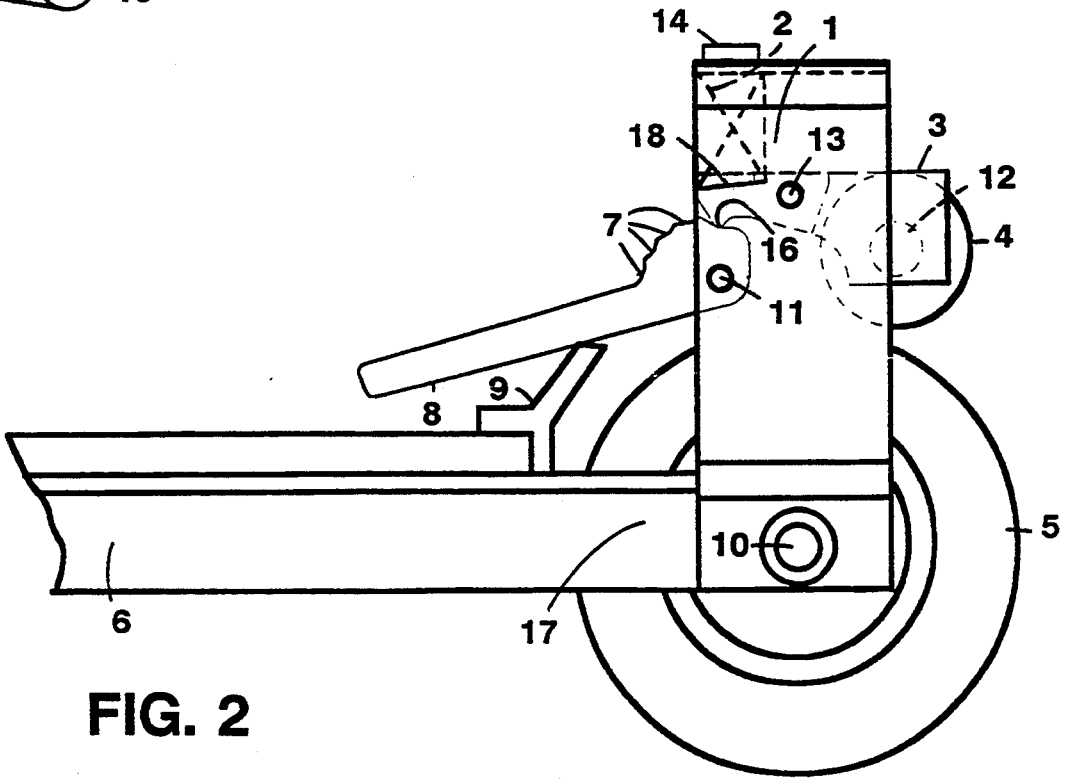
FIG. 2 is a partial side elevation showing a speed reducer mounted on the front end of the FIG. 1 roller ski.

Referring to FIG. 2, there is shown the aluminum base member of the roller ski 6 and front wheel 5 rotatably mounted on the forks of the roller ski 17. The frame structure 1 is mounted to the fork 17 with the wheel bolt 10. The roller 4 is housed in a slotted portion of the first pivotable member 3, and rotates about pin 12 which is pressed into a suitably sized slot of pivotable member 3. In the free or neutral position shown, roller 4 does not contact the wheel 5. The first pivotable member 3 is rotatably mounted to the frame structure 1 with metallic pins 13. The compression spring 2 is captured in the first pivotable member 3 by a suitably sized depression 18 and is held in the frame structure 1 by a pop rivet 14.

The second pivotable member 8 is mounted to the frame structure 1 by a metallic pin 11 and is held in the neutral position by the plastic member 9, enabling the hand of the user to slide under the extended portion of the member 8. Suitably sized indentations 7, of second pivotable member 8, receive the lobe 16 of first pivotable member 3.

Figure 3:
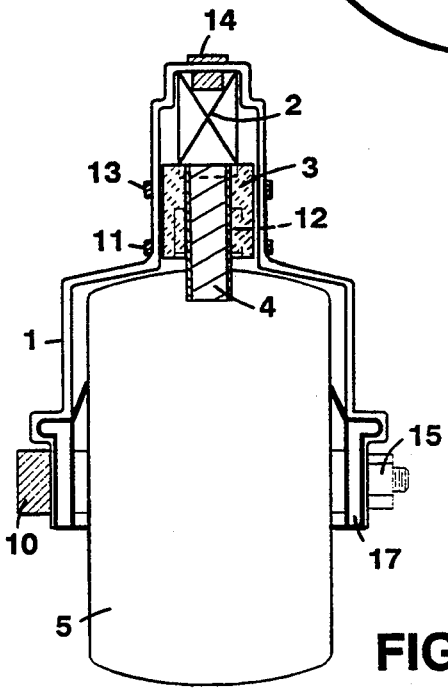
FIG. 3 is a front elevation showing the FIG. 2 speed reducer mounted on the FIG. 1 roller ski.

Referring to FIG. 3, there is shown the front wheel 5 rotatably mounted on the forks of the roller ski 17 with bolt 10 and nut 15. The frame structure 1 is mounted to the fork 17 with the wheel bolt 10 and nut 15. The roller 4 is housed in a slotted portion of the first pivotable member 3, and rotates about pin 12 which is pressed into a suitably sized slot of first pivotable member 3. In the free neutral position shown, roller 4 does not contact the wheel 5. The first pivotable member 3 is rotatably mounted to the frame structure 1 with metallic pins 13. The compression spring 2 is captured in the first pivotable member 3 by a suitably sized depression and is held in the frame structure 1 by a pop rivet 14. The second pivotable member is mounted to the frame structure 1 by a metallic pin 11.

Figure 4:
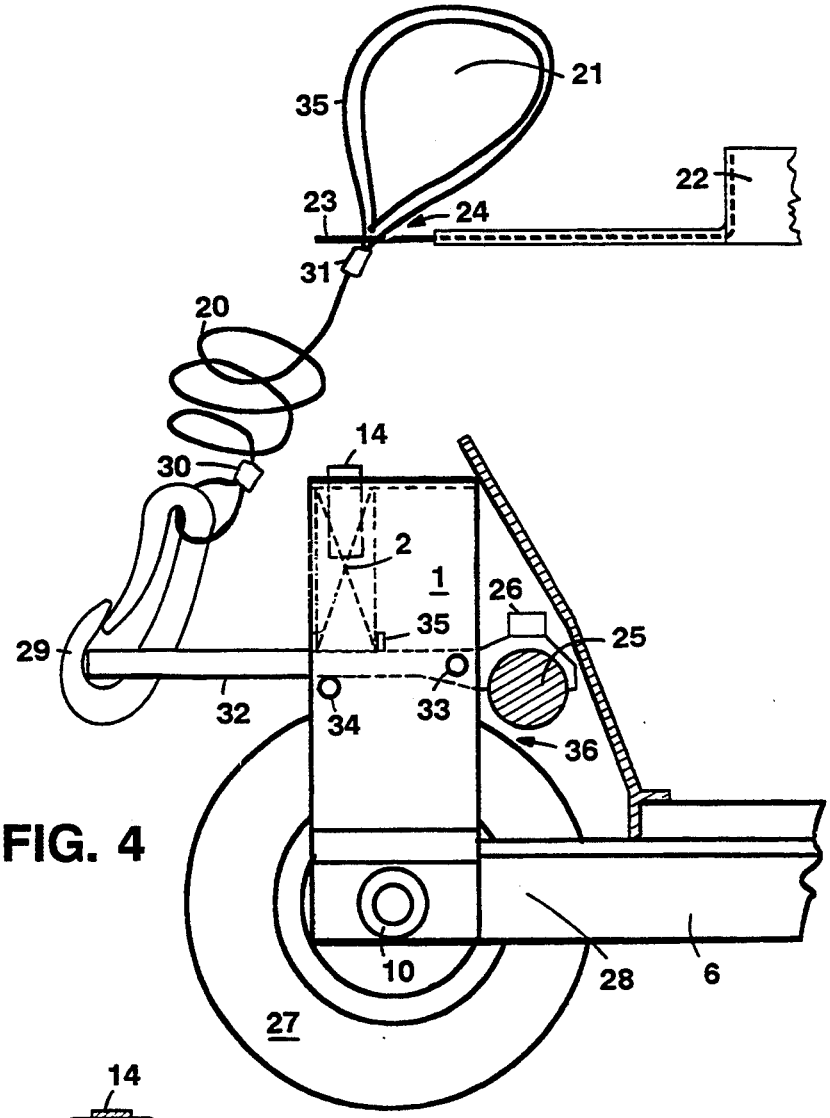
FIG. 4 is a partial side elevation showing a brake mounted on the rear end of the FIG. 1 roller ski.

Referring to FIG. 4, there is shown the aluminum base member of the roller ski 6 and rear wheel 27 rotatably mounted on the rear forks of the roller ski 28. The frame structure 1, identical to the frame structure 1 of FIGS. 1 and 2, is mounted to the rear fork 28 with the wheel bolt 10. The lever 32 is rotatably mounted to the frame structure 1 with metallic pin 33. The brake pad 25 is secured to the lever 32 with retaining screw 26. The geometry of the lever 32, where the brake pad 25 is attached, is such that the structure matches the geometry of the cylindrical brake pad 25 reducing the force load on the retaining screw 26 when the brake pad 25 is forced against the wheel 27. The lever 32 is pressed against stop 34 by a compression spring 2. Compression spring 2 is secured to the lever 32 by vertical walls 35 and to the frame 1 by a pop rivet 14. The coiled cable 20 is secured to the retaining clip 29 by retaining crimp lug 30. The other end of coiled cable 20 passes through a plastic tube 35 and a loop is formed by having the cable 20 attached to itself by crimp lug 31. The leg strap 22 is wrapped around the user's leg and is secured by hook and loop fasteners (e.g., Velcro). Entrapped by, and protruding in perpendicular fashion from, the leg strap 22 is a pliable plastic insert 23, with a hole 24 of a diameter sufficient to allow loop 21 to be passed through the hole when the loop 21 is compressed. After the loop 21 has passed through the hole 24, energy within the loop 21 returns it to its normal shape retaining it in place. When in the neutral position shown, there is ample clearance 36 between the brake pad 25 and the wheel 27.

Figure 5:
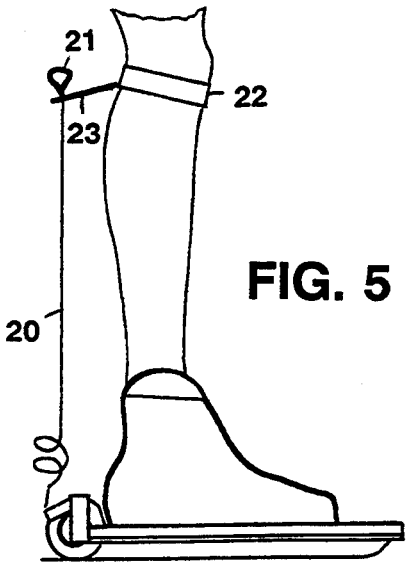
FIG. 5 is a diagrammatic partial side elevation showing attachment of a leg strap and cable on a leg of a user of the FIG. 1 roller ski.

Referring to FIG. 5 there is shown the leg strap 22 mounted to the user's leg and the plastic insert 23, loop 21 and cable 20.

Operation

In operation the user's boot is attached to binding 37, and with ski poles in hand the user alternately pushes backwards and rolls, simulating classical cross country skiing, or alternately pushes the roller skis sideways and backward and rolls developing forward locomotion by a skating motion, known as free style skiing. This is also the motion used by in-line skaters. When approaching a downhill grade, where greater rolling resistance is desired to reduce speed, the user bends forward and pushes second pivotable member 8 forward so that lobe 16 engages the second indentation 7, thus causing the roller 4 to press into the elastomeric material of the wheel 5. If additional rolling resistance is desired, the second pivotable member 8 is pushed forward until the lobe of the first pivotable member 16 engages the next indentation 7.

On steeper downhill slopes, the second pivotable member 8 would generally be pushed forward until lobe 16 of the first pivotable member 3 would engage the third indentation 7. The fourth, or last indentation 7 of the second pivotable member 8, is normally used only after the wheel 5 has seen extensive use and is worn, thus causing the wheel to be smaller in diameter. With roller skis having a wheel geometry as described in U.S. Pat. No. 4,898,403, expert skiers can control roller ski speed on less steep hills by snow plowing, whereby the front of the roller skis are pushed towards each other and the back of the skis are spread apart forming a V, thus increasing rolling resistance through frictional rotation. However, on medium grade or steeper hills this is not possible even for expert skiers, because the leg force required to maintain this position is too great. Most roller skis with conventional wheel geometry, i.e., other than the geometry shown in U.S. Pat. No. 4,898,403, cannot be snow plowed.

With the use of the speed reducer invention it is not necessary to use the snowplow maneuver, and with the rear mounted brake it is now possible to further reduce speed or to stop by pulling on the coiled cable attached to the brake lever. In practice the invention works extremely well and users have found it very easy to learn.

Other Embodiments

Other embodiments are within the scope of the following claims. For example, other materials and other dimensions could be used. The speed reducer could be activated by a rotating pressure member such as a threaded rod pushing the roller against the wheel or a different kind of leverage system than described in the preferred embodiments. The speed reducer and brake could be mounted in different fashion than with the bolt and nut securing the wheel. The detailed description of the speed reducer and brake is for a roller ski, but the invention is equally suitable for in-line skates with rotatably mounted elastomeric wheels and other similar foot supporting roller devices.

What is claimed is:

1. A foot-supporting rolling device comprising:

a foot supporting structure for supporting a user's foot, first and second wheels rotatably mounted on said foot supporting structure, said first wheel being made of elastomeric material of a first hardness, and a roller mounted on said foot supporting structure in such a fashion that it can be forced against said first wheel so as to provide a resistance to the rotation of the wheel, further comprising a first movable member mounted on said foot supporting device and carrying said roller thereon, said first movable member being movable between positions in which the axis of said roller is at different distances from the axis of said first wheel wherein said first movable member has a plurality of different speed reducing positions in which said roller contacts said first wheel, the axis of said roller being at different distances from the axis of said first wheel in said different speed reducing positions, said different speed reducing positions providing different wheel rolling resistances, wherein said first movable member is lockable into said different speed reducing positions, wherein said first movable member is pivotally mounted on said foot supporting structure, and wherein a second movable member locks said first movable member in said different positions, and wherein said second movable member is pivotally mounted about a second member axis and has a plurality of contact surfaces that contact said first movable member at a contact member thereof when in said different positions, said contact surfaces being at different radial distances from said second member axis.

2. The rolling device of claim 1 wherein said roller is made of material that has hardness greater than said first hardness.

3. The rolling device of claim 2 wherein said roller is narrower than said wheel and is forced into said wheel.

4. The rolling device of claim 1 wherein said first movable member has a neutral position in which said roller does not contact said first wheel.

5. The rolling device of claim 1 wherein said contact surfaces are at indentations that are movable into and out of contact with said contact member by pivoting said second member.

6. The rolling device of claim 5 wherein said first movable member is spring biased against said second movable member and away from said first wheel.

7. The rolling device of claim 1 wherein said foot supporting structure includes a binding for engaging a boot, and said rolling device is a roller ski.

8. The rolling device of claim 1 wherein said foot supporting structure includes a boot for receiving a user's foot therein, and said rolling device is an in-line roller skate.

9. The rolling device of claim 1 wherein said first wheel is a front wheel.

10. The rolling device of claim 1 wherein said first wheel is a rear wheel.

11. The rolling device of claim 1 further comprising a brake that engages said second wheel.

12. The rolling device of claim 11 where said second wheel is made of elastomeric material of a second hardness, and wherein said brake includes a brake pad made of material that has hardness greater than said second hardness, said brake pad being movably mounted with respect to said second wheel in such a manner that the brake pad can be forced against the outer diameter of said second wheel.

13. The rolling device of claim 12 wherein said brake includes a lever that is pivotally mounted on said foot supporting structure, said lever supporting said brake pad.

14. The rolling device of claim 13 further comprising a cable connected to said lever such that pulling on said cable causes said brake pad to be forced against said second wheel.

15. The rolling device of claim 14 wherein the lever is so configured that, when the cable is pulled, the force at the brake pad is greater than the force at the cable.

16. The rolling device of claim 15 wherein the brake pad has a neutral position in which it does not contact said second wheel.

17. The rolling device of claim 14 wherein said cable is coiled in such a manner that it self-retracts, yet uncoils with sufficiently low resistance so that body movements of the user on said rolling device do not to interfere with the user's motion or inadvertently activate the brake.

18. The rolling device of claim 17 further comprising a leg strap attached to said cable wherein the coiled cable is attached to the user via said leg strap secured on the leg, either above or below the knee.

19. The rolling device of claim 18 of further comprising a pliable plastic insert entrapped by the leg strap and, protruding in perpendicular fashion from the leg strap, which retains the cable and a looped grip attached to said cable in such a manner that it can easily be activated by the user.

* * * * *